United States Patent [19]

Yamori et al.

[11] Patent Number: 4,623,557

[45] Date of Patent: Nov. 18, 1986

[54] PROCESS FOR THE PRODUCTION OF HEAT-SENSITIVE RECORDING MATERIALS

[75] Inventors: Tsunefumi Yamori, Hyogo; Shuki Okauchi; Hironari Fujioka, both of Osaka, all of Japan

[73] Assignee: Kanzaki Paper Mfg. Co., Ltd., Tokyo, Japan

[21] Appl. No.: 723,342

[22] Filed: Apr. 15, 1985

[30] Foreign Application Priority Data

Apr. 17, 1984 [JP] Japan ..... 59-78216

[51] Int. Cl.[4] ..... B05D 3/06

[52] U.S. Cl. ..... 427/44; 427/56.1

[58] Field of Search ..... 427/44, 56.1; 430/348; 346/200

[56] References Cited

U.S. PATENT DOCUMENTS 3,330,682 7/1967 Tamura ..... 430/296
3,914,510 10/1975 Glanz et al. ..... 430/348
4,321,309 3/1982 Mino et al. ..... 430/348
4,421,839 12/1983 Takiguchi et al. ..... 430/348
4,444,819 4/1984 Maruta et al. .
4,484,204 11/1984 Yamamoto et al. ..... 346/200
4,513,301 4/1985 Takayama et al. ..... 346/200

*Primary Examiner*—John H. Newsome
*Attorney, Agent, or Firm*—Finnegan, Henderson, Farabow, Garrett & Dunner

[57] ABSTRACT

A process for the production of heat-sensitive recording materials is described, comprising the steps of (1) applying to a support a coating composition comprising a color former, a color developer, and at least one of a water-soluble binder and a water-dispersible binder, to form a layer, and (2) irradiating the layer with electron beams. Images recorded on the heat-sensitive recording material exhibit superior stability. The color density of the recorded images remains stable even when the recording material is moistened with water or placed in a high humidity atmosphere. Further, even moistened recorded images do not disappear when rubbed with a finger.

3 Claims, No Drawings

PROCESS FOR THE PRODUCTION OF HEAT-SENSITIVE RECORDING MATERIALS

BACKGROUND OF THE INVENTION

The present invention relates to a process for producing heat-sensitive recording materials which provide developed images by the reaction between a color former and a color developer upon heating.

Conventional heat-sensitive recording materials, widely used in facsimiles, various printers, or electrocardiographs, for example, exhibit an undesirable lack of stability in high humidity conditions. If these recording materials are subjected to high humidity conditions after recording, the density of recorded images decreases and finally fades to such an extent that the images can no longer be read. Further, if the recorded images are rubbed with fingers or with a cloth after contact with moisture, they readily disappear.

SUMMARY OF THE INVENTION

An object of the present invention is to overcome the above defects, i.e., poor resistance to water or moisture, of conventional heat-sensitive recording materials.

To achieve the above object and in accordance with the purpose of the invention, as embodied and broadly described herein, the process of this invention comprises the steps of (1) applying to a support a coating composition comprising a color former, a color developer, and at least one of a water-soluble binder and a water-dispersible binder, to form a layer, and (2) irradiating the layer with electron beams.

In another embodiment, the claimed invention comprises drying the layer formed as above, applying to this first layer a resin coating composition comprising at least one of a water-soluble binder and a water-dispersible binder to form a second layer, and irradiating both layers with electron beams.

Either the coating composition applied to the support to form the first layer or the resin coating composition applied to the first layer to form the second layer, or both, may further comprise a water-soluble or water-dispersible electron beam-curable monomer or a water-soluble or water-dispersible electron beam-curable prepolymer.

DESCRIPTION OF THE PREFERRED EMBODIMENT

Color former/color developer combinations useful in the present invention are typically combinations of colorless or pale-colored basic dyes and inorganic or organic acidic substances; combinations of higher fatty acid metal salts, such as ferric stearate, and phenols, such as gallic acid; and combinations of diazo compounds and couplers.

Examples of colorless or pale-colored basic dyes which can be used in the coating composition of the heat-sensitive recording material of the present invention include triarylmethane-based dyes such as 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, and 3-p-dimethylaminophenyl-3-(1-methylpyrrole-3-yl)-6-dimethylaminophthalide; diphenylmethane-based dyes such as 4,4'-bis-dimethylaminobenzhydrylbenzylether, N-halophenyl-leucoauramine, and N-2,4,5-trichlorophenyl-leucoauramine; thiazine-based dyes such as benzoyl-leucomethyleneblue, and p-nitrobenzoyl-leucomethyleneblue; spiro-based dyes such as 3-methyl-spiro-dinaphthopyran, 3-ethyl-spiro-dinaphthopyran, 3-phenyl-spiro-dinaphthopyran, 3-benzyl-spiro-dinaphthopyran, 3-methylnaphtho(6'-methoxybenzo)spiropyran, and 3-propyl-spiro-dibenzopyran; lactam-based dyes such as rhodamine-B-anilinolactam, rhodamine(p-nitroanilino)lactam, and rhodamine(o-chloroanilino)-lactam; and fluoran-based dyes such as 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)fluoran, 3-diethylamino-7-methylaminofluoran, 3-diethylamino-7-dibenzylaminofluoran, 3-diethylamino-7-(N-methyl-N-benzylamino)fluoran, 3-diethylamino-7-(N-chloroethyl-N-methylamino)fluoran, 3-diethylamino-7-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-dibutylamino-6-methyl-7-phenylaminofluoran, 3-(N-ethyl-N-cyclopentyl)amino-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-(N-methyl-N-n-amyl-)amino-6-methyl-7-phenylaminofluoran, 3-(N-ethyl-N-isoamyl)amino-6-methyl-7-phenylaminofluoran, 3-(N-methyl-N-n-hexyl)amino-6-methyl-7-phenylaminofluoran, 3-(N-ethyl-N-n-hexyl)amino-6-methyl-7-phenylaminofluoran, 3-(N-ethyl-N-tetrahydrofurfuryl-)amino-6-methyl-7-phenylaminofluoran, 3-diethylamino-7-(2-carbomethyloxy-phenylamino)fluoran, 3-diethylamino-7-(o-chlorophenylamino)fluoran, 3-dibutylamino-7-(o-chlorophenylamino)fluoran, and 3-dibutylamino-7-(l-fluorophenylamino)fluoran. The present invention is not limited to these exemplified basic dyes. Rather, these basic dyes can be used either alone or in admixture with each other or with other dyes shown to be useful in heat-sensitive recording materials.

Color developers which are used in combination with the color formers as described above are not critical in the present invention. Various substances known to be capable of forming a color upon coming into contact with the color formers can be used. Representative examples of such color developers include inorganic acidic substances such as activated clay, acidic clay, attapulgite, bentonite, colloidal silica, and aluminum silicate; and organic acidic substances including phenolic compounds such as 4-tert-octylphenol, 4,4'-sec-butylidenediphenol, 4-phenylphenol, 4,4'-isopropylidenediphenol, 4,4'-cyclohexylidenediphenol, 4,4'-dihydroxydiphenyl sulfide, 4,4'-thiobis(6-tert-butyl-3-methylphenol), 4,4'-dihydroxydiphenylsulfone, 4-hydroxy-4'-methyldiphenylsulfone, 4-hydroxy-4'-chlorodiphenylsulfone, hydroquinone monobenzyl ether, 4-hydroxybenzophenone, 2,4-dihydroxybenzophenone, 2,4,4'-trihydroxybenzophenone, 2,2',4,4'- tetrahydroxybenzophenone, dimethyl 4-hydroxyphthalate, methyl 4-hydroxybenzoate, ethyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenetyl 4-hydroxybenzoate, p-chlorobenzyl 4-hydroxybenzoate, p-methoxybenzyl 4-hydroxybenzoate, novolak phenol resins, and phenol polymers; aromatic carboxylic acids such as benzoic acid, p-tert-butylbenzoic acid, trichlorobenzoic acid, terephthalic acid, 3-sec-butyl-4-hydroxybenzoic acid; 3-cyclohexyl-4-hydroxybenzoic acid, 3,5-dimethyl-4-hydroxybenzoic acid, salicyclic acid, 3-isopropylsalicylic acid, 3-tert-butylsalicylic acid, 3-benzylsalicylic acid, 3-(α-methylbenzyl)salicylic acid, 3-chloro-5-(α-methylbenzyl)salicylic acid, 3,5-di-tert-butylsalicylic acid, 3-phenyl-5-(α,α-dimethylbenzyl)-salicylic acid, and 3,5-di-α-methylbenzylsalicylic acid; and salts of such phenolic compounds or aromatic carboxylic acids with polyvalent metals such as zinc, magnesium, aluminum, calcium, titanium, manganese, tin, and nickel.

In connection with the ratio of the color former to the color developer, the amount of the color developer used is generally from 100 to 700 parts by weight, preferably from 150 to 400 parts by weight, per 100 parts by weight of the color former. If desired, the color developer may be used as a mixture comprising two or more thereof.

The coating composition, containing the above-described color former and color developer, is generally prepared in the form of an aqueous dispersion using, for example, a ball mill, an attritor, or a sand mill. To the aqueous dispersion is added a water-soluble binder and/or a water-dispersible binder. Various binders which may be used for this purpose include entirely or partially saponified polyvinyl alcohol; acetoacetylated polyvinyl alcohol in which an acetoacetyl group is introduced by reacting polyvinyl alcohol and diketene; carboxy-modified polyvinyl alcohol such as the reaction products of polyvinyl alcohol and polyvalent carboxylic acids, such as fumaric acid, phthalic anhydride, trimellitic anhydride, and itaconic anhydride, esterified products of such reaction products, and compounds resulting from saponification of copolymers of vinyl acetate and ethylenically unsaturated carboxylic acids, such as maleic acid, fumaric acid, itaconic acid, crotonic acid, acrylic acid, and methacrylic acid; sulfonic acid-modified polyvinyl alcohol resulting from saponification of copolymers of vinyl acetate and olefinsulfonic acids such as ethylenesulfonic acid and allylsulfonic acid, or their salts; olefin-modified polyvinyl alcohols resulting from saponification of copolymers of vinyl acetate and olefins such as ethylene, propylene, isobutylene, α-octene, α-dodecene, and α-octadodecene; nitrile-modified polyvinyl alcohol resulting from saponification of copolymers of vinyl acetate and nitriles such as acrylonitrile and methacrylonitrile; amide-modified polyvinyl alcohol resulting from saponification of copolymers of vinyl acetate and amides such as acrylamide and methacrylamide; pyrrolidone-modified polyvinyl alcohol resulting from saponification of a copolymer of vinyl acetate and N-vinylpyrrolidone; modified polyvinyl alcohol containing silicon in the molecule thereof; cellulose derivatives such as methyl cellulose, ethyl cellulose, hydroxyethyl cellulose, and carboxymethyl cellulose; casein; gum arabic; starches such as oxidized starch, etherified starch, and esterified starch; and emulsions of copolymers such as a styrene/butadiene copolymer, a vinyl acetate/ethylene copolymer, a vinyl acetate/vinyl chloride/ethylene copolymer, and a methacrylate/butadiene copolymer.

Of these binders, various modified polyvinyl alcohols, cellulose derivatives, and casein are preferred. Particularly preferred are acetoacetylated polyvinyl alcohol and carboxy-modified polyvinyl alcohol.

The amount of the water-soluble binder and/or water-dispersible binder added is not critical, but usually varies from 10 to 40% by weight, preferably from 15 to 30% by weight, based on the total weight of solids of the coating composition.

To the binder may be added a water-proof agent such as glyoxal, methylolmelamine, potassium persulfate, ammonium persulfate, sodium persulfate, ferric chloride, magnesium chloride, boric acid, and ammonium chloride. In addition, hydroxides such as LiOH, NaOH, KOH, $Mg(OH)_2$, $Ca(OH)_2$, $Ba(OH)_2$, and $NH_4OH$, amine-based basic substances such as dimethylaminoethanol, diethylamine, morpholine, ethylenediamine, and pyridine, and salts of the above basic substances and weak acids, such as ammonium borate, sodium borate, ammonium carbonate, ammonium hydrogencarbonate, sodium carbonate, sodium hydrogencarbonate, ammonium phosphate, sodium phosphate, sodium tartarate, ammonium tartarate, sodium citrate, and ammonium citrate may be added to obtain the effects of the present invention more efficiently.

The coating composition may further contaain auxiliary agents. Examples of such auxiliary agents are dispersants such as sodium dioctylsulfosuccinate, sodium dodecylbenzenesulfonate, sodium lauryl sulfate, and fatty acid metal salts; ultraviolet light absorbers such as triazole-based compounds; defoaming agents; fluorescent dyes, and coloring dyes. In order that the heat-sensitive recording material does not stick upon coming into contact with a recording device or a recording head, lubricants such as dispersions or emulsions of stearic acid, polyethylene, carnauba wax, paraffin wax, zinc stearate, calcium stearate, and ester wax may be added to the coating composition. In addition, in order to reduce the attachment of tailings to the recording head, inorganic pigments such as kaolin, clay, talc, calcium carbonate, calcined clay, titanium oxide, diatomaceous earth, fine granular anhydrous silica, and activated clay can be added to the coating composition. Still further, if desired, fatty acid amides such as stearic acid amide, stearic acid methylenebisamide, oleic acid amide, parmitic acid amide, sperm oleic acid amide, and coconut fatty acid amides; hindered phenols such as 2,2'-methylene-bis(4-methyl-6-tert-butylphenol), and 1,1,3-tris-(2-methyl-4-hydroxy-5-tert-butylphenyl)butane; ethers such as 1,2-bis(phenoxy)ethane, 1,2-bis(4-methylphenoxy)ethane, 1,2-bis(3-methylphenoxy)ethane, and 2-naphthol benzyl ether; esters such as dibenzyl terephthalate, and phenyl 1-hydroxy-2-naphthoate; and various other known heat-fusible substances may be added as sensitizers.

The coating composition is applied to a support such as paper, a synthetic paper, or a film by techniques such as air knife coating or blade coating to form a layer. The amount of the coating composition applied to form the layer is not critical but usually varies from 2 to 12 $g/m^2$, preferably from 3 to 10 $g/m^2$, on a dry weight basis.

The coating composition applied to the support to form a layer is then irradiated with electron beams. The irradiation may be performed immediately after applying the coating composition or after applying and drying the coating composition. Preferably, the irradiation is performed immediately after applying the coating composition and before drying.

Although it is not completely clear why the resistance to water and moisture of the heat-sensitive recording material is improved when irradiation with electron beams is performed either after applying the coating composition or after applying and drying the coating composition, it is believed that the binder contained in the coating composition undergoes a cross-linking reaction upon irradiation.

Further, the present inventors have found that, if a part of the binder used in the coating composition of the heat-sensitive recording material (together with the color former and color developer) is substituted with an electron beam-curable prepolymer or an electron beam-curable monomer, a heat-sensitive recording material having excellent moisture resistance and water resistance can be obtained. Any water-soluble or water-dispersible prepolymer or monomer containing an ethylenically unsaturated double bond which is curable by irradiation with electron beams can be used in the present invention.

Examples of useful electron beam-curable prepolymers include:

(a) Poly(meth)acrylates of aliphatic, alicyclic, or araliphatic polyhydric (having from 2 to 6 alcoholic hydroxy groups) alcohols or polyalkylene glycols, such as esterified compounds of polyhydric alcohols (e.g., ethylene glycol and propylene glycol) or polyalkylene glycols (e.g., polyethylene glycol) and (meth)acrylic acid;

(b) Poly(meth)acrylates of polyhydric alcohols resulting from addition of alkylene oxides to aliphatic, alicyclic or araliphatic polyhydric (having from 2 to 6 alcoholic hydroxy groups) alcohols, such as esterified compounds of polyhydric alcohols resulting from addition of alkylene oxides (e.g., ethylene oxide) to polyhydric alcohols (e.g., pentaerythritol) and (meth)acrylic acid;

(c) Poly(meth)acryloyloxyalkyl phosphates resulting from reaction of hydroxy group-containing (meth)acrylates and phosphorus pentoxide, e.g., poly(meth)acryloyloxyethyl phosphate;

(d) Polyester poly(meth)acrylates resulting from esterification of (meth)acrylic acid, polyhydric alcohols, and polycarboxylic acids, e.g., di(meth)acrylate of polyester diol between maleic acid and ethylene glycol, di(meth)acrylate or polyester diol between phthalic acid and diethylene glycol, and poly(meth)acrylate of polyester diol between adipic acid and triethylene glycol;

(e) Epoxy poly(meth)acrylates which are a reaction product of (meth)acrylic acid and epoxy resin resulting from reaction of polyhydric phenols and epichlorohydrin, e.g., a reaction product of bisphenol A-diglycidyl ether-based epoxy resin and (meth)acrylic acid;

(f) Polyurethane poly(meth)acrylates such as reaction products of hydroxy group-containing (meth)acrylates (e.g., 2-hydroxyethyl (meth)acrylate) and diisocyanate;

(g) Polyamide poly(meth)acrylates such as reaction products of polyamide-based polycarboxylic acids (e.g., that resulting from reaction of ethylenediamine and phthalic acid) and hydroxy group-containing (meth)acrylates (e.g., 2-hydroxyethyl (meth)acrylate);

(h) Polysiloxane poly(meth)acrylates such as reaction products of polysiloxane bond unit-containing polyhydric alcohols and (meth)acrylic acid or hydroxy group-containing (meth)acrylates;

(i) Low molecular weight vinyl or diene polymers containing (meth)acryloyloxy group in the side chain and/or terminal thereof, such as reaction products of copolymers of (meth)acrylic acid and other vinyl monomer and glycidyl (meth)acrylate; and (j) Modified products of the oligoester (meth)acrylates of (a) to (i) above, such as modified products obtained by modifying a part of the hydroxy or carboxyl groups remained in the oligoester with an acid chloride, an acid anhydride, or an isocyanate.

Examples of useful electron beam-curable monomers include:

I. Monofunctional Unsaturated Monomers (1) Carboxyl group-containing monomers exemplified by ethylenically unsaturated mono- or poly-carboxylic acids (e.g., maleic acid, fumaric acid, and itaconic acid), and carboxylic acid salt group-containing monomers such as alkali metal salts, ammonium salts, and amine salts of the foregoing monomers;

(2) Amide group-containing monomers exemplified by ethylenically unsaturated (meth)acrylamides or alkyl-substituted (meth)acrylamides (e.g., N,N-dimethyl (meth)acrylamide), and vinyl lactams (e.g., N-vinylpyrrolidone);

(3) Sulfonic acid group-containing monomers exemplified by aliphatic or aromatic vinylsulfonic acids, and sulfonic acid salt group-containing monomers such as the alkali metal, ammonium and amine salts of the foregoing vinylsulfonic acids, e.g., 2-acrylamido-2-methylpropanesulfonic acid;

(4) Hydroxyl group-containing monomers exemplified by ethylenically unsaturated esters, such as tripropylene glycol mono(meth)acrylate;

(5) Amino group-containing monomers such as dimethylaminoethyl (meth)acrylate and 2-vinylpyridine;

(6) Quaternary ammonium salts group-containing monomers such as N,N,N-trimethyl-N-(meth)acryloyloxyethylammonium chloride;

(7) Alkyl esters of ethylenically unsaturated carboxylic acids, such as methyl (meth)acrylate and ethyl (meth)acrylate;

(8) Nitrile group-containing monomers such as (meth)acrylonitrile;

(9) Styrene;

(10) Ethylenically unsaturated alcohol esters such as vinyl acetate and (meth)allyl acetate; and

(11) Mono(meth)acrylates of alkylene oxide adducts of compounds containing active hydrogen (e.g., monohydric alcohols, phenols, carboxylic acids, amines, and amides).

II. Difunctional Unsaturated Monomers (1) Ester group-containing difunctional monomers exemplified by diesters of polyols and ethylenically unsaturated carboxylic acids, such as trimethylolpropane di(meth)acrylate, and diesters of polybasic acids and unsaturated alcohols, such as diallyl phthalate;

(2) Difunctional diesters of (meth)acrylic acid and alkylene oxide adducts of compounds containing active hydrogen (e.g., polyhydric alcohols, phenols, carboxylic acids, amines, and amides) such as pentanediol propylene oxide adduct;

(3) Bisacrylamides such as N,N-methylenebisacrylamide; and (4) Difunctional compounds such as divinylbenzene, divinylethylene glycol, divinylsulfone, divinyl ether, and divinyl ketone.

III. Polyfunctional Unsaturated Monomers (1) Ester group-containing polyfunctional monomers exemplified by polyesters of polyols and ethylenically unsaturated carboxylic acids, such as trimethylolpropane (meth)acrylate and dipentaerythritol hexa(meth)acrylate, and polyesters of polycarboxylic acids and unsaturated alcohols, such as triallyl trimellitate;

(2) Polyfunctional monomers exemplified by polyesters of alkylene oxide adducts of compounds containing active hydrogen (e.g., polyhydric alcohols, polyhydric phenols, polycarboxylic acids, polyamines, and polyamides) and (meth)acrylic acid; and (3) Polyfunctional unsaturated monomers such as trivinylbenzene.

Of the above-described electron beam-curable prepolymers or monomers, those which are soluble in water can be added directly to the coating composition for heat-sensitive recording material. Water-dispersible prepolymers or monomers are generally stirred with water in the presence of a surfactant to form an oil-in-water type emulsion, which is then added to the coating composition of the heat-sensitive recording material. Further, electron beam-curable prepolymers and monomers may be used in a mixture in which both prepolymers and monomers are present.

Examples of surfactants which may be used include anionic surfactants such as fatty acid salts, higher alcohol sulfuric acid ester salts, alkylbenzenesulfonic acid salts, alkylnaphthalenesulfonic acid salts, a naphthalenesulfonic acid/formalin condensate, dialkylsulfosuccinic acid salts, alkyl phosphate salts, and polyoxyethylene sulfate salts; nonionic surfactants such as polyoxyethylene alkyl ethers, polyoxyethylene alkylphenol ethers, sorbitan fatty acid esters, polyoxyethylene sorbitan fatty acid esters, and polyoxyethylene acyl esters; cationic surfactants such as alkylamine salts, quaternary ammonium salts, and polyoxyethylenealkylamines; and water-soluble polymers such as polyvinyl alcohol. These surfactants may be used singly or in combination with each other. Of these compounds, nonionic surfactants having an HLB of at least 10 are preferable to obtain emulsions having greatly increased stability.

The amount of the surfactant used is usually from 0.01 to 20% by weight, preferably from 0.05 to 10% by weight, based on the weight of the monomer or prepolymer.

It is desirable to add an amount of the electron beam-curable monomer or prepolymer, according to the present invention, which will substitute for about 1 to 80% by weight, preferably 3 to 60% by weight, of the binder component in the coating composition. If the amount is less than 1% by weight, satisfactory results are not obtained. Further, if the amount of the water-dispersible compound, in the form of an oil-in-water type emulsion, exceeds 80% by weight, the surfactant present adversely affects the stability of the coating composition and background fog is generated in the layer formed by the coating composition.

Although the reason why the moisture and water resistance is improved when an electron beam-curable monomer or prepolymer is substituted for a portion of the binder is not completely clear, it is believed that the presence of the monomer or prepolymer, having many active sites, accelerates the crosslinking reaction when irradiated with electron beams.

Furthermore, the present inventors have found that heat-sensitive recording materials having extremely excellent moisture and water resistance can be produced by applying to the support the above-described coating composition to form a first layer, drying the first layer, forming a second layer by applying to the first layer either (A) a resin coating composition comprising at least one of a water-soluble binder and a water-dispersible binder or (B) a resin coating composition comprising a mixture of (a) at least one of a water-soluble binder and a water-dispersible binder and (b) at least one of a water-soluble electron beam-curable monomer, a water-soluble electron beam-curable prepolymer, a water-dispersible electron beam-curable monomer, and a water-dispersible electron beam-curable prepolymer, and irradiating the first and second layers with electron beams.

The thus produced heat-sensitive recording material not only exhibits excellent moisture and water resistance but also exhibits improved plasticizer resistance. By plasticizer resistance is meant that the color density of images recorded on a heat-sensitive recording material which has been stored in contact with a plastic film is not greatly reduced, as would be normally expected, by the plasticizer contained in the plastic film.

In accordance with the present invention, the resin coating composition used to form the second layer can comprise any of the water-soluble binders, water-dispersible binders, and the water-soluble or water-dispersible electron beam-curable monomers or prepolymers, listed above for use in the coating composition used to form the first layer of the heat-sensitive recording layer. However, it is preferred to use a resin coating composition containing at least one member selected from the group consisting of various modified polyvinyl alcohols, cellulose derivatives, and casein, or a mixture of at least one member selected from the foregoing group and at least one member selected from the group consisting of water-soluble or water-dispersible electron beam-curable monomers and water-soluble or water-dispersible electron beam-curable prepolymers. In particular, a heat-sensitive recording material produced by the use of a resin coating composition containing at least one member selected from the group consisting of acetoacetylated polyvinyl alcohol and carboxy-modified polyvinyl alcohol, or a mixture of at least one member selected from the foregoing group and at least one member selected from the group consisting of water-soluble or water-dispersible electron beam-curable monomers and water-soluble or water-dispersible electron beam-curable prepolymers exhibits especially excellent moisture resistance, water resistance, and plasticizer resistance.

In accordance with the present invention, when the resin coating composition comprises a mixture of a water-soluble binder and/or water-dispersible binder and a water-soluble or water-dispersible electron beam-curable monomer or prepolymer, the amount of the electron beam-curable monomer or prepolymer is desirably adjusted to fall in the range of from 1 to 80% by weight, preferably from 3 to 60% by weight, of the whole resin component.

Any water-dispersible binder or water-dispersible electron beam-curable monomer or prepolymer used is employed as an oil-in-water type emulsion as described above.

If desired, in order to improve printability and sticking, pigments may be added to the resin coating composition. Examples of the pigment which may be used include inorganic pigments such as calcium carbonate, zinc oxide, aluminum oxide, titanium dioxide, silicon dioxide, aluminum hydroxide, barium sulfate, zinc sulfate, talc, kaolin, clay, calcined clay, and colloidal silica; and organic pigments such as styrene microball, nylon powder, polyethylene powder, urea/formalin resin filler, and raw starch particles. The pigment is usually used in an amount of from 5 to 500 parts by weight, preferably from 80 to 350 parts by weight, based on 100 parts by weight of the resin component.

Furthermore, if desired, the resin coating composition used to form a second layer may further contain the waterproof agents, hydroxides, amine-based basic substances, salts of these basic substances and weak acids, as well as the lubricants, dispersants, defoaming agents, ultraviolet light absorbers, fluorescent dyes, and coloring dyes exemplified above for the coating composition used to form the first layer of the heat-sensitive recording material.

In accordance with the present invention, the resin coating composition is prepared as an aqueous composition and, if appropriate, is thoroughly mixed and dispersed by means of, for example, a mixer, an attritor, a ball mill, or a roll mill, and then applied to the first layer by means of conventional coating apparatus to form a second layer. The amount of the resin coating composition applied is not particularly critical. However, it is desirable to adjust it within the range of from 0.1 to 20 $g/m^2$, preferably from 0.5 to 10 $g/m^2$, on a dry weight basis, since there is a possibility that the recording sensitivity of the heat-sensitive recording material will be decreased if the amount exceeds 20 $g/m^2$.

After applying the resin coating composition to the first layer to form a second layer, the first and second layer are irradiated with electron beams. The irradiation can be performed either immediately after applying the resin coating composition or after applying and drying the resin coating composition. However, heat-sensitive recording materials having a more excellent quality are obtained when the irradiation with electron beams is performed immediately after applying the resin coating composition. Although the first layer, to which the resin coating composition is applied to form a second layer, must be dried, the effects of the invention are increased by irradiating the first layer per se with electron beams either before or after drying it.

Either after applying the coating composition to the support to form the first layer of the heat-sensitive recording material, or after applying and drying it, or after applying the resin coating composition to the first layer of the heat-sensitive recording layer, or after applying and drying it, the layer(s) present are irradiated with electron beams, the dose of which is preferably from 0.1 to 15 Mrad. Less than desirable results are obtained if the dose of electron beams used for irradiating is less than 0.1 Mrad. On the other hand, if the dose is in excess of 15 Mrad, color contamination of the coated surface occurs, resulting in a reduction of whiteness and of product quality.

Irradiation with electron beams can be performed in any suitable manner such as the scanning method, the curtain beam method, or the broad beam method. A suitable acceleration voltage employed in the irradiation with electron beams is from about 100 to 300 KV.

In the thus-produced heat-sensitive recording material of the present invention, the cross-linking reaction of the binder component of the first layer, and the second layer if present, is accelerated by irradiation with electron beams. The resulting recording material exhibits excellent moisture resistance, water resistance, and plasticizer resistance.

If desired, the desirable effects of the invention may be increased even more by providing the support side of the heat-sensitive recording material with a resin layer, too. Also, if desired, various techniques known in the art of producing heat-sensitive recording materials, such as providing a subbing layer on the support, treating the support side of the recording material with a tackifier, and/or processing into a tacky label, may be employed in the present invention.

The present invention is described in greater detail with reference to the following examples. All parts and percents are by weight unless otherwise indicated.

EXAMPLE 1

| | |
|---|---|
| Dispersion A | |
| 3,3-Bis(p-dimethylaminophenyl)-6-dimethylaminophthalide | 10 parts |
| 5% Aqueous solution of polyvinyl alcohol (PVA-110 produced by Kuraray Co., Ltd.; degree of saponification: 98 mol %, degree of polymerization: 1,100) | 10 parts |
| Water | 15 parts |
| Dispersion B | |
| 4,4'-Isopropylidenediphenol | 20 parts |
| 5% Aqueous solution of polyvinyl alcohol (PVA-110) | 10 parts |
| Water | 40 parts |

Dispersions A and B were pulverized separately by means of a sand mill to an average particle diameter of about 3 μm. 35 Parts of Dispersion A, 70 parts of Dispersion B, 25 parts of calcium carbonate, 25 parts of fine granular anhydrous silica, and 270 parts of a 15% aqueous solution of polyvinyl alcohol (PVA-110) were mixed to prepare a coating composition for heat-sensitive recording material. This coating composition was applied to a paper support (basis weight: 50 $g/m^2$) at a dry weight of 5.0 $g/m^2$, irradiated with 2 Mrad of electron beams at an acceleration voltage of 170 KV, and then dried to produce a heat-sensitive recording paper.

The resulting recording paper was evaluated for moisture resistance and water resistance by the following methods.

Moisture Resistance

The recording paper was recorded with a commercially available heat-sensitive facsimile apparatus (MELFAS-550 manufactured by Mitsubishi Denki K.K.) and the color density (initial color density ($d_1$)) of the recorded image was measured with a Macbeth reflection densitometer (Model RD-100R of Macbeth Corp.). Thereafter, the recording paper was allowed to stand at 40° C. and 90% RH (relative humidity) for 50 hours, and the color density ($d_2$) was again measured. The respective color densities and retention [$(d_2/d_1)\times 100(\%)$] are shown in Table 1.

Water Resistance

One drop of water was placed on the surface of the recording paper recorded in the same manner as above. After 30 seconds, the moistened recording paper was rubbed once back and forth with a finger, and the appearance of the recorded images was visually evaluated. The results are shown in Table 1.

EXAMPLES 2 TO 9

Eight heat-sensitive recording papers were produced in the same manner as in Example 1 except that 270 parts of each of an aqueous solution of acetoacetylated polyvinyl alcohol (Gohsefimer Z-200 produced by The Nippon Synthetic Chemical Industry Co., Ltd.) (Example 2), an aqueous solution of carboxy-modified polyvinyl alcohol (T-330 produced by The Nippon Synthetic Chemical Industry Co., Ltd.) (Example 3), an aqueous solution of sulfonic acid-modified polyvinyl alcohol (Example 4), an aqueous solution of methyl cellulose (Example 5), an aqueous solution of oxidized starch (Example 6), an aqueous solution of casein (Example 7), a styrene-butadiene copolymer emulsion (JSR-0696 produced by Japan Synthetic Rubber Co., Ltd.) (Example 8), and an aqueous solution of acetoacetylated polyvinyl alcohol (Gohsefimer Z-200) containing boric acid in an amount of 1% based on the solids content of polyvinyl alcohol (Example 9), each having a concentration of 15%, was used in place of 270 parts of the 15% aqueous solution of polyvinyl alcohol (PVA-110) used in the coating composition for the heat-sensitive recording material of Example 1. These recording papers were evaluated in the same manner as in Example 1. The results are shown in Table 1.

EXAMPLE 10

A heat-sensitive recording paper was produced in the same manner as in Example 1 except that the irradiation with electron beams was not performed until after drying the coating composition. This recording paper was evaluated in the same manner as in Example 1. The results are shown in Table 1.

COMPARATIVE EXAMPLES 1 TO 9

Heat-sensitive recording papers were produced in the same manner as in Examples 1 to 9, respectively except that the coating composition was not irradiated with electron beams. These recording papers were evaluated in the same manner as in Example 1. The results are shown in Table 1.

TABLE 1

| | Moisture Resistance | | | |
|---|---|---|---|---|
| | Initial Color Density ($d_1$) | Color Density after Allowing to Stand at 40° C. and 90% RH for 50 Hours ($d_2$) | Retention ($d_2/d_1 \times 100$) (%) | Water[1] Resistance |
| Example | | | | |
| 1 | 1.30 | 1.07 | 82 | C |
| 2 | 1.30 | 1.08 | 83 | A |
| 3 | 1.29 | 1.06 | 82 | A |
| 4 | 1.31 | 1.06 | 81 | B |
| 5 | 1.29 | 1.04 | 81 | B |
| 6 | 1.28 | 1.02 | 80 | C |
| 7 | 1.29 | 1.04 | 81 | B |
| 8 | 1.28 | 1.05 | 82 | C |
| 9 | 1.31 | 1.15 | 88 | A |
| 10 | 1.32 | 1.06 | 80 | C |

TABLE 1-continued

| | Moisture Resistance | | | |
|---|---|---|---|---|
| | Initial Color Density ($d_1$) | Color Density after Allowing to Stand at 40° C. and 90% RH for 50 Hours ($d_2$) | Retention ($d_2/d_1 \times 100$) (%) | Water[1] Resistance |
| Comparative Example | | | | |
| 1 | 1.30 | 0.61 | 47 | D |
| 2 | 1.30 | 0.72 | 55 | D |
| 3 | 1.30 | 0.78 | 60 | D |
| 4 | 1.28 | 0.77 | 60 | D |
| 5 | 1.29 | 0.71 | 55 | D |
| 6 | 1.28 | 0.60 | 47 | D |
| 7 | 1.29 | 0.83 | 64 | D |
| 8 | 1.28 | 0.82 | 64 | D |
| 9 | 1.31 | 0.85 | 65 | D |

[1]Water resistance
A: The recorded images did not fade at all.
B: The recorded images faded slightly, but images remained clear.
C: The recorded images faded considerably, but images remained readable.
D: The recorded images completely disappeared, and reading was impossible.

EXAMPLE 11

| | |
|---|---|
| Dispersion A | |
| 3,3-Bis(p-dimethylaminophenyl)-6-dimethylaminophthalide | 10 parts |
| 5% Aqueous solution of polyvinyl alcohol (PVA-110) | 10 parts |
| Water | 15 parts |
| Dispersion B | |
| 4,4'-Isopropylidenediphenol | 20 parts |
| 5% Aqueous solution of polyvinyl alcohol (PVA-110) | 10 parts |
| Water | 40 parts |

Dispersions A and B were pulverized separately by means of a sand mill to an average particle diameter of about 3 μm.

Separately, 50 g of the prepolymer of polyester polyacrylate (Aronix M-8060 produced by Toagosei Chemical Industry Co., Ltd.) was placed into a beaker, and 35 g of a 10% aqueous solution of polyoxyethylene nonylphenyl ether surfactant (Emulgen 935 (HLB: 17.5) produced by Kao Atlas Co., Ltd.) was added thereto with stirring. 50 g of water was further added to obtain a 40% oil-in-water type emulsion of the polyester polyacrylate.

35 parts of Dispersion A, 70 parts of Dispersion B, 25 parts of calcium carbonate, 25 parts of fine granular anhydrous silica, 260 parts of a 5% aqueous solution of acetoacetylated polyvinyl alcohol (Gohsefimer Z-200), and 30 parts of the 40% emulsion of polyester polyacrylate were mixed to prepare a coating composition for heat-sensitive recording material. This coating composition was applied to a paper support (basis weight: 40 g/m$^2$) at a dry weight of 4 g/m$^2$, irradiated with 2 Mrad of electron beams, and then dried to produce a heat-sensitive recording paper. The resulting recording paper was evaluated for moisture resistance and water resistance by the following methods. The results are shown in Table 2.

Moisture Resistance

The evaluation was performed in the same manner as in Example 1.

Water Resistance

One drop of water was placed on the surface of the recording paper recorded by the heat-sensitive facsimile apparatus of Example 1. After one minute, the resulting recording paper was rubbed with a finger five times back and forth, and the appearance of the recorded images was visually evaluated.

EXAMPLES 12 TO 15

Four heat-sensitive recording papers were produced in the same manner as in Example 11 except that 260 parts of each of a 5% aqueous solution of carboxy-modified polyvinyl alcohol (T-330) (Example 12), a 5% aqueous solution of methyl cellulose (Example 13), a 5% aqueous solution of casein (Example 14), and a 5% aqueous solution of acetoacetylated polyvinyl alcohol (Gohsefimer Z-200) to which boric acid had been added in an amount of 2% based on the solids content of polyvinyl alcohol (Example 15), was used in place of 260 parts of the 5% aqueous solution of acetoacetylated polyvinyl alcohol used in the coating composition. These recording papers were evaluated in the same manner as in Example 11. The results are shown in Table 2.

EXAMPLE 16

A heat-sensitive recording paper was produced in the same manner as in Example 11 except that 30 parts of a 40% emulsion of trimethylolpropane triacrylate prepared in the manner described below was used in place of 30 parts of the 40% emulsion of polyester polyacrylate used in the coating composition. The recording paper was evaluated in the same manner as in Example 11. The results are shown in Table 2.

Preparation of Trimethylolpropane Triacrylate Emulsion 4 g of polyoxyethylene nonylphenyl ether (Emulgen 935) was dissolved in 100 g of trimethylolpropane triacrylate (M-309 produced by Toagosei Chemical Industry Co., Ltd.), and 156 g of water was gradually added thereto by means of a homomixer with stirring (rate of revolution: 3000 to 4000 rpm) to obtain a 40% oil-in-water type emulsion of trimethylolpropane triacrylate.

EXAMPLE 17

A heat-sensitive recording paper was produced in the same manner as in Example 11 except that 260 parts of a 5% aqueous solution of carboxy-modified polyvinyl alcohol (T-330) and 30 parts of the 40% emulsion of trimethylolpropane triacrylate prepared in Example 16 were used in place of the acetoacetylated polyvinyl alcohol aqueous solution and the polyester polyacrylate emulsion used in the coating composition, respectively. The recording paper was evaluated in the same manner as in Example 11. The results are shown in Table 2.

EXAMPLES 18 AND 19

Two heat-sensitive recording papers were produced in the same manner as in Example 11 except that 30 parts of each of a 35% mixed emulsion of polyurethane polyacrylate/tri(propyloxy) diacrylate (Example 18) and a 40% emulsion of epoxy polyacrylate (Example 19), each having been prepared in the manner described below, was used in place of the polyester polyacrylate used in the coating composition. These recording papers were evaluated in the same manner as in Example 11. The results are shown in Table 2.

Preparation of Mixed Emulsion of Polyurethane Polyacrylate/Tri(propyloxy)Diacrylate 40 g of a prepolymer of polyurethane polyacrylate (M-1100 produced by Toagosei Chemical Industry Co., Ltd.) was mixed with 60 g of tri(propyloxy)diacrylate (M-220 produced by Toagosei Chemical Industry Co., Ltd.), and 35 g of a 10% aqueous solution of a polyoxyethylene nonylphenyl ether-based nonionic surfactant (Emulgen 950 (HLB: 18.2) produced by Kao Atlas Co., Ltd.) was added to the mixture for dissolution. Thereafter, 160 g of water was gradually added thereto by means of a homomixer with stirring (rate of revolution: 2500 to 3000 rpm) to obtain an oil-in-water type mixed emulsion of polyurethane polyacrylate/tri(propyloxy)-diacrylate (solids content: 35%).

Preparation of Epoxy Polyacrylate Emulsion 4 g of lauryl alcohol sulfuric acid ester ammonium salt (Emal A produced by Kao Atlas Co., Ltd.), as a surfactant, was dissolved in 100 g of a prepolymer of epoxy polyacrylate (Unidick V-5502 produced by Dainippon Ink & Chemicals, Inc.), and 156 g of water was gradually added to the solution by means of a homomixer with stirring (rate of revolution: 4000 to 4500 rpm) to obtain a 40% oil-in-water type emulsion of epoxy polyacrylate.

COMPARATIVE EXAMPLES 10 TO 18

Nine heat-sensitive recording papers were produced by the same methods as in Examples 11 to 19, respectively except that the irradiation with electron beams was not performed. These heat-sensitive recording papers were evaluated in the same manner as in Example 11. The results are shown in Table 2.

TABLE 2

| | Moisture Resistance | | | |
|---|---|---|---|---|
| | Initial Color Density ($d_1$) | Color Density after Allowing to Stand at 40° C. and 90% RH for 50 Hours ($d_2$) | Retention ($d_2/d_1 \times 100$) (%) | Water[1] Resistance |
| Example | | | | |
| 11 | 1.30 | 1.17 | 90 | A |
| 12 | 1.28 | 1.15 | 90 | A |
| 13 | 1.28 | 1.09 | 85 | B |
| 14 | 1.29 | 1.11 | 86 | B |
| 15 | 1.31 | 1.21 | 92 | A |
| 16 | 1.26 | 1.13 | 90 | B |
| 17 | 1.27 | 1.13 | 89 | B |
| 18 | 1.27 | 1.17 | 92 | A |
| 19 | 1.31 | 1.19 | 91 | A |
| Comparative Example | | | | |
| 10 | 1.10 | 0.60 | 55 | D |
| 11 | 1.15 | 0.60 | 52 | D |
| 12 | 1.18 | 0.60 | 51 | D |
| 13 | 1.18 | 0.63 | 53 | D |
| 14 | 1.24 | 0.72 | 58 | D |
| 15 | 1.20 | 0.63 | 53 | D |
| 16 | 1.20 | 0.62 | 52 | D |
| 17 | 1.13 | 0.62 | 55 | D |
| 18 | 1.00 | 0.50 | 50 | D |

[1]Water resistance
A: The recorded images did not fade at all.
B: The recorded images faded slightly, but images remained clear.
D: The recorded images completely disappeared, and reading was impossible.

EXAMPLE 20

A coating composition for a heat-sensitive recording material obtained in the same manner as in Example 1 was applied to a paper support (basis weight: 50 g/m$^2$) at a dry weight of 5.0 g/m$^2$ and then dried without irradiating with electron beams to produce a first layer. To this first layer, a resin coating composition having the formulation described below was applied at a dry weight of 5 g/m$^2$ to form a second layer. The resulting recording paper was irradiated with 5 Mrad of electron beams and then dried to produce a heat-sensitive recording paper having two layers.

| Formulation of Resin Coating Composition | |
|---|---|
| 10% Aqueous solution of acetoacetylated polyvinyl alcohol (Gohsefimer Z-200) | 1,000 parts |
| Calcium carbonate (Softon 1200 produced by Bihoku Funka K.K.) | 100 parts |

EXAMPLES 21 TO 27

Seven heat-sensitive recording papers having two layers were produced in the same manner as in Example 20 except that each of the resin coating compositions having the formulations described below was used in place of the resin coating composition of Example 20.

| Formulation of Resin Coating Composition | |
|---|---|
| In Example 21: | |
| 10% Aqueous solution of acetoacetylated polyvinyl alcohol (Gohsefimer Z-200) | 1,000 parts |
| Calcium carbonate (Softon 1200) | 100 parts |
| 3% Aqueous solution of potassium hydroxide | 65 parts |
| In Example 22: | |
| 10% Aqueous solution of carboxy-modified polyvinyl alcohol (T-330) | 1,000 parts |
| Kaolin (UW-90 produced by Engelhard Minerals & Chemicals Corp.) | 100 parts |
| In Example 23: | |
| 10% Aqueous solution of casein | 1,000 parts |
| Kaolin (UW-90) | 100 parts |
| In Example 24: | |
| 10% Aqueous solution of methyl cellulose | 1,000 parts |
| Calcium carbonate (Softon 1500 produced by Bihoku Funka K.K.) | 100 parts |
| In Example 25: | |
| 10% Aqueous solution of polyvinyl alcohol (PVA-110) | 700 parts |
| 40% Emulsion of polyester polyacrylate prepared in Example 11 | 75 parts |
| Kaolin (UW-90) | 100 parts |
| In Example 26: | |
| 10% Aqueous solution of polyvinyl alcohol (PVA-110) | 500 parts |
| 40% Emulsion of polyester polyacrylate prepared in Example 11 | 125 parts |
| Kaolin (UW-90) | 100 parts |

-continued

| Formulation of Resin Coating Composition | |
|---|---|
| In Example 27: | |
| 10% Aqueous solution of carboxy-modified polyvinyl alcohol (KL-318 produced by Kuraray Co., Ltd.) | 500 parts |
| 40% Emulsion of polyester polyacrylate prepared in Example 11 | 125 parts |
| Kaolin (UW-90) | 100 parts |

COMPARATIVE EXAMPLES 19 TO 26

Eight heat-sensitive recording papers having two layers were produced in the same manner as in Examples 20 to 27 except that, after the formation of the second layer, irradiation with electron beams was omitted.

The sixteen heat-sensitive recording papers having two layers produced in Examples 20 to 27 and Comparative Examples 19 to 26 were evaluated by the following methods. The results are shown in Table 3.

Background Color Density

The respective recording papers were processed in a checked pattern by means of a heat-sensitive facsimile apparatus (MELFAS-550), and the density of the non-colored area was measured with a Macbeth reflection densitometer (Model RD-100R). The lower the value, the less the fog.

Initial Color Density

The initial color density ($d_1$) of the colored area of the recording paper processed in the same manner as above, was measured with a Macbeth reflection densitometer.

Moisture Resistance

The colored recording paper was allowed to stand at 40° C. and 90% RH for 50 hours, the color density ($d_2$) was again measured with the Macbeth reflection densitometer, and retention $[(d_2/d_1)\times 100\ (\%)]$ was calculated.

Water Resistance

The colored recording paper was immersed in water for 15 hours and air dried. The color density ($d_3$) was then measured with the Macbeth reflection densitometer and retention $[(d_3/d_1)\times 100\ (\%)]$ was calculated.

Plasticizer Resistance

The colored recording paper was disposed between two polyvinyl chloride wrapping films (produced by Mitsui Toatsu Chemicals Inc.) and allowed to stand at room temperature for 14 days. Thereafter, the color density ($d_4$) was measured with the Macbeth reflection densitometer, and retention $[(d_4/d_1)\times 100\ (\%)]$ was calculated.

TABLE 3

| | Background Color Density | Initial Color Density ($d_1$) | Moisture Resistance | | Water Resistance | | Plasticizer Resistance | |
|---|---|---|---|---|---|---|---|---|
| | | | Color Density ($d_2$) | Retention ($d_2/d_1 \times 100$) (%) | Color Density ($d_3$) | Retention ($d_3/d_1 \times 100$) (%) | Color Density ($d_4$) | Retention ($d_4/d_1 \times 100$) (%) |
| Example | | | | | | | | |
| 20 | 0.08 | 1.40 | 1.11 | 79 | 1.35 | 96 | 1.10 | 79 |
| 21 | 0.07 | 1.38 | 1.14 | 83 | 1.36 | 99 | 1.13 | 82 |
| 22 | 0.08 | 1.41 | 1.10 | 78 | 1.34 | 95 | 1.08 | 77 |
| 23 | 0.08 | 1.42 | 1.04 | 73 | 1.27 | 89 | 0.91 | 64 |
| 24 | 0.08 | 1.37 | 1.02 | 74 | 1.21 | 88 | 0.93 | 68 |

TABLE 3-continued

| | Background Color Density | Initial Color Density ($d_1$) | Moisture Resistance Color Density ($d_2$) | Moisture Resistance Retention ($d_2/d_1 \times 100$) (%) | Water Resistance Color Density ($d_3$) | Water Resistance Retention ($d_3/d_1 \times 100$) (%) | Plasticizer Resistance Color Density ($d_4$) | Plasticizer Resistance Retention ($d_4/d_1 \times 100$) (%) |
|---|---|---|---|---|---|---|---|---|
| 25 | 0.08 | 1.39 | 1.01 | 73 | 1.23 | 88 | 0.89 | 64 |
| 26 | 0.09 | 1.39 | 1.04 | 75 | 1.28 | 92 | 0.85 | 61 |
| 27 | 0.08 | 1.41 | 1.13 | 80 | 1.37 | 97 | 0.90 | 64 |
| Comparative Example | | | | | | | | |
| 19 | 0.09 | 1.41 | 0.78 | 55 | 0.71 | 50 | 0.61 | 43 |
| 20 | 0.08 | 1.43 | 0.82 | 57 | 0.75 | 52 | 0.63 | 44 |
| 21 | 0.08 | 1.41 | 0.73 | 52 | 0.78 | 55 | 0.60 | 43 |
| 22 | 0.08 | 1.38 | 0.69 | 50 | 0.71 | 51 | 0.56 | 41 |
| 23 | 0.08 | 1.37 | 0.66 | 48 | 0.70 | 51 | 0.53 | 39 |
| 24 | 0.09 | 1.38 | 0.65 | 47 | 0.66 | 48 | 0.49 | 36 |
| 25 | 0.09 | 1.39 | 0.60 | 43 | 0.63 | 45 | 0.41 | 29 |
| 26 | 0.08 | 1.40 | 0.63 | 45 | 0.70 | 50 | 0.48 | 34 |

The results show that, not only can heat-sensitive recording materials having excellent moisture resistance and water resistance in accordance with the present invention be obtained, but also those embodiments of the invention further comprising a second layer comprising a resin coating composition applied to the first layer exhibit excellent plasticizer resistance.

While the invention has been described in detail and with reference to specific embodiments thereof, it will be apparent to one skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. A process for producing a heat-sensitive recording material comprising the steps of (1) applying to a support a coating composition comprising a color former, a color developer, at least one of a water-soluble binder and a water-dispersible binder, and at least one member selected from the group consisting of a water-soluble electron beam-curable monomer, a water-soluble electron beam-curable prepolymer, a water-dispersible electron beam-curable monomer, and a water-dispersible electron beam-curable prepolymer, to form a layer; and (2) irradiating the layer with electron beams.

2. A process for producing a heat-sensitive recording material comprising the steps of (1) applying to a support a coating composition comprising a color former, a color developer, and at least one of a water-soluble binder and a water-dispersible binder, to form a first layer; (2) drying the first layer; (3) applying to the first layer a resin coating composition comprising at least one of a water-soluble binder and a water-dispersible binder to form a second layer; and (4) irradiating the first and second layers with electron beams.

3. A process as claimed in claim 2, wherein said resin coating composition further comprises at least one member selected from the group consisting of a water-soluble electron beam-curable monomer, a water-soluble electron beam-curable prepolymer, a water-dispersible electron beam-curable monomer, and a water-dispersible electron beam-curable prepolymer.

* * * * *